United States Patent [19]

Snyer et al.

[11] 4,160,412

[45] Jul. 10, 1979

[54] EARTH FRACTURING APPARATUS

[75] Inventors: William H. Snyer, Littleton; Ralph E. Williams; John Wisotski, both of Denver, all of Colo.

[73] Assignees: Thomas A. Edgell; Roberta K. Tillinghast, both of Houston, Tex.

[21] Appl. No.: 810,072

[22] Filed: Jun. 27, 1977

[51] Int. Cl.[2] ..... E21B 43/11

[52] U.S. Cl. ..... 102/20; 102/24 HC; 102/DIG. 2; 166/63; 166/299; 175/4.6

[58] Field of Search ..... 102/20, 22, 23, 24 HC, 102/DIG. 2; 175/4.6; 166/297, 299, 63; 299/13

[56] References Cited

U.S. PATENT DOCUMENTS

| | | | |
|---|---|---|---|
| 2,587,244 | 2/1952 | Sweetman | 102/24 HC |
| 2,775,940 | 1/1957 | Klotz, Jr. | 102/23 |
| 2,984,307 | 5/1961 | Barnes | 102/24 HC |
| 3,076,408 | 2/1963 | Poulter et al. | 102/DIG. 2 |
| 3,762,326 | 10/1973 | Edgell et al. | 102/20 |
| 4,064,935 | 12/1977 | Mohaupt | 166/299 |

FOREIGN PATENT DOCUMENTS

| | | | |
|---|---|---|---|
| 1172591 | 6/1964 | Fed. Rep. of Germany | 102/24 HC |

*Primary Examiner*—Verlin R. Pendegrass
*Attorney, Agent, or Firm*—Kyle W. Rost

[57] ABSTRACT

An earth fracturing apparatus has a casing of reactive metal containing a central, double ended charge load that is simultaneously detonated from both ends; and a pair of opposed end charges at opposite sides of the central charge load, the end charges being concavely dished toward the central charge load and having a liner of reactive metal on the dished face. The end charges are simultaneously peripherally initiated to explode with a collapsing detonation wave toward the central charge load. Void spaces between each end charge and the central charge load contain an oxidizer that may be under pressure. In a modified form of the apparatus, the end charges are omitted and the central charge load alone acts as a perforator for well pipe.

22 Claims, 4 Drawing Figures

EARTH FRACTURING APPARATUS

BACKGROUND OF THE INVENTION

1. Field of the Invention

This invention relates to explosive devices and to boring and penetrating the earth. More specifically, the invention relates to well-treating apparatus for increasing the flow rate in oil or gas recovery operations.

2. Description of the Prior Art

Oil and gas recovery from a given strata requires that the strata be permeable, allowing oil or gas from remote areas to migrate toward the well. It is known in the art that recovery levels are often reduced because of well fouling caused by foreign matter, sedimentation, or paraffin build-up near the well bore. A commonly used technique that restores greater flow rate of the oil or gas is to fracture the mineral bearing formation, thereby increasing the effective permeability of the strata and creating clear passages for flow of the mineral.

Known methods of fracturing the mineral bearing formation include hydrofracing and the use of explosives, the advantages and the problems of which are well known in the art, as described in U.S. Pat. No. 3,762,326 to Edgell teaching the use of controlled directional charges between opposing pancake charges and acting on a liquid to fracture a formation. Edgell teaches the use of shaped charges capable of directing the force of the explosion in a controlled direction, using the "Monroe Principle". Experimental work with controlled directional charges of the kind disclosed in the Edgell patent reveals that the fracturing efficiency of this kind of charge can be substantially increased through certain structural changes, which are the subject of the present disclosure.

A number of different configurations of shaped charges are known in the prior art. U.S. Pat. No. 3,013,491 to Poulter teaches the use of radially directed conical charges to perforate well casings. U.S. Pat. No. 2,935,020 to Howard teaches the use of axially and circumferentially directed charges to cut windows in well casing. Other shape variations are taught in U.S. Pat. No. 2,831,429 to Moore. Thus, the cutting of longitudinal slots, circular perforations, or windows through the use of shaped charges that utilize the Monroe Principle is well known in the prior art. In operation, a shaped charge such as a conical charge having a V-shaped inner face detonates from the apex of the V and directs the explosive force in a jet that exits the open end of the V and exerts its force over a relatively narrow target area.

SUMMARY OF THE INVENTION

A casing contains centrally located shaped charges and spaced, inwardly directed dished charges having a surface coating of reactive metal. In use, the shaped charges are first detonated to perforate the well casing and initiate fractures in the oil and gas bearing formation, and after a brief delay and dished charges are detonated to enhance the pressures generated by the shaped charges, increasing the amount of resultant fracturing in the formation and thereby producing a cavity in the formation of larger volume than would be produced by an equivalent quantity of explosive detonated in prior art devices or by prior art methods.

An object of the invention is to initiate cracks in an oil or gas bearing formation to increase permeability and mineral flow. Often a formation is porous enough to contain a substantial quantity of oil and gas, but the formation lacks permeability that allows the mineral flow to the well. Other times, a formation may become sealed by asphalt, paraffin, or other matter that accumulates near the well and chokes the flow of mineral. In either event, flow can be restored by fracturing the formation, creating new passages for the mineral flow. The present invention is an improved apparatus and method for propagating cracks.

Another object of the invention is to create a simple device for creating one or more cavities in a bore hole for receiving explosives that can then be detonated for massive fracturing of a mineral bearing formation. The cavity created by the present apparatus is well suited for containing secondary explosive material.

An important object of the invention is to create an apparatus and method that can pre-treat a bore hole immediately prior to the application of other simulation techniques, such as hydrofracing. The present device is extremely efficient in fracturing a rock strata, and further bore hole treatment is substantially more successful after the strata has been initially fractured by the apparatus. Hydrofracing involves injecting large quantities of water under pressure into a bore hole, and the water does the work of fracturing the strata and cleaning blockages from the area near the well. When the strata is pretreated with the present apparatus, the work required by the water is substantially reduced and the success rate of the hydrofracing operation is correspondingly increased. It is anticipated that the apparatus could be used both as a pretreatment immediately before applying other techniques, or in conjunction with the application of such other known techniques.

Another important object is to direct and enhance the force of an explosion to provide superior crack initiation in mineral strata. The force of explosions has been directed in the past by using shaped charges and spaced charges to concentrate the force of an explosion, but the present apparatus provides superior direction for the force of the explosion and prolongs the pressure duration, resulting in greater fracturing of rock.

A further important object of the invention is to use reactive metals in conjunction with dished charges to allow more useful work to be done in the strata. Reactive metals on the surface of the dished charges has been found to greatly prolong the period of pressure enhancement, leading to greater crack initiation.

DESCRIPTION OF THE PREFERRED EMBODIMENT

Figure 1:
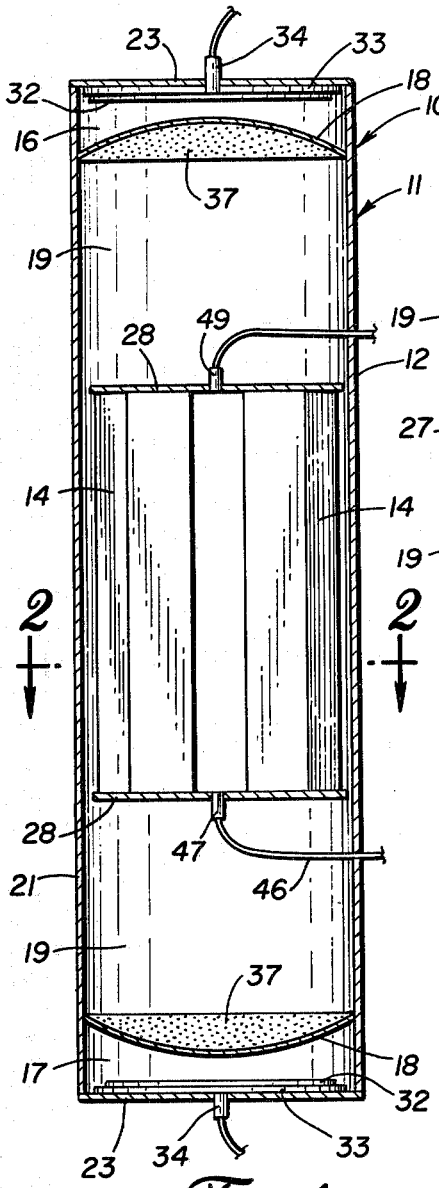
FIG. 1 is a vertical cross sectional view of an earth fracturing apparatus consisting of a single charge unit.

The earth fracturing apparatus 10 of the present invention, as best shown for a single charge unit 11 in FIG. 1, includes an outer casing 12 containing a centrally located charge load 14 and inwardly directed, opposed, peripherally initiated end charges 16 and 17 located respectively at the top and bottom ends of casing 12 for each charge unit 11. Each end charge has a reactive metal liner on its inward facing surface 18 and a void 19 separates the end charge from the central charge load 14. Suitable detonators are connected to the apparatus 10 to initiate the central charge and the end charges, and the casing 12 is connected to conventional means for lowering the apparatus to the desired depth in a well bore. The apparatus operates by creating initial fractures in the earth through the explosion of the central charge load 14 and by then enlarging these fractures through enhanced and prolonged pressures generated by the detonation of the end charges, the energy of which is used to create a directional, near-field effect reaction between a metallic vapor cloud and oxygen. The reaction creates overpressures for far longer periods than has been achieved with prior explosive devices and results in increased amounts of useful work done in the mineral bearing strata.

Casing 12 may be an axially elongated cylinder having cylinder wall 21 of suitable diameter to be freely lowered into a well bore. In many modern wells, a three inch diameter cylinder is a suitable size, but older wells of larger bore may require a broader casing. It is desirable that the casing be close to the diameter of the well so that the force of the explosion is not unduly dissipated along the length of the bore. The top and bottom of the cylinder may be sealed by caps or disks 23 through threaded connections, as is known in the art. The axial length of the casing may be adjusted to accommodate different amounts and configurations of explosive and to create proper space for voids 19 according to the configuration of end charges 16 and 17. In a preferred configuration of the apparatus shown in FIG. 4, the casing 12 is greatly elongated to contain a plurality of charge units 11 stacked end to end, each charge unit including a central or primary charge load 14 and secondary or end charges 16 and 17.

The casing of the apparatus 10 is consumed in the explosion of its contained charges and therefore is not reusable. Accordingly, it is desirable that the casing be frangible and have the minimum wall thickness that can withstand the pressures of the well environment, in order for the explosion to expend a minimum of energy on rupturing the casing and a maximum of energy on fracturing the earth. A casing wall 21 of from one-fourth to five-sixteenth inch has been found suitable for most applications. Preferred materials for casing construction include aluminum, magnesium, or alloys thereof. Lithium or other reactive metal or alloys thereof may be used in combination with either or both metals to enhance their reactive properties, so that the casing may participate in the chemical reaction of the metallic vapor cloud and oxygen.

Figure 3:
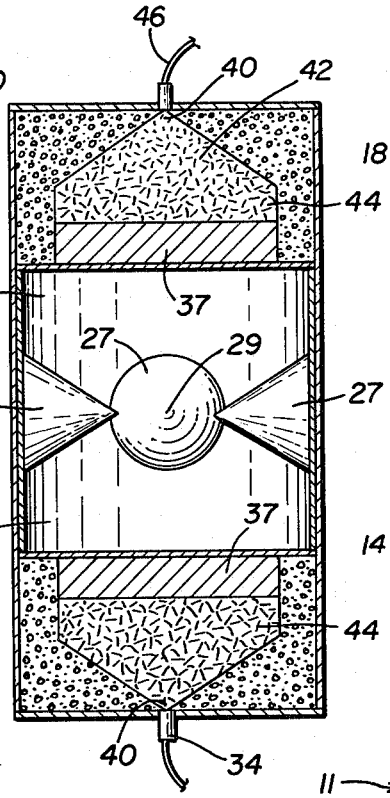
FIG. 3 is a vertical cross sectional view of a modified earth fracturing apparatus.
Figure 2:
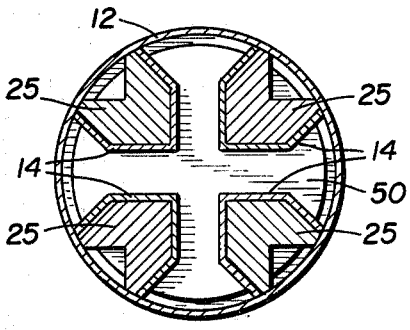
FIG. 2 is a horizontal cross sectional view taken through the plane of line 22--2 of FIG. 1, showing the configuration of the linear shaped charges.

The central charge load 14 is suspended in casing 12 near the lengthwise center of the charge unit 11, for example by a cardboard divider frictionally supporting the charge load in the casing. The charges forming the central charge load 14 may be any form of conventional shaped charges, such as a plurality of linear vanes 25 arranged parallel to the casing axis and directing the force of their explosion in a radially outward direction. Although four charges are illustrated in FIG. 2, the number of charges may be adjusted for different purposes and different casing sizes. An arrangement of conical charges as shown in U.S. Pat. No. 3,013,419 to Poulter may be substituted for the linear charges to concentrate the force of the primary explosion along a narrow plane transverse to the axis of the well, for example to fracture a narrow rock strata. FIG. 3 illustrates a proposed configuration for the use of conical shaped charges 27.

In a typical configuration, the linear shaped charges of FIG. 1 may be sandwiched between an upper and lower sheets of sheet explosive 28, such as DuPont Detasheet, and both upper and lower sheets would be detonated at the same moment so that the explosion would peak at the center of the axial length of the linear charges, which is also the approximate axial center of the charge unit 11. Where a ring of outwardly directed conical charges 27 of FIG. 3 is used, the conical charges are detonated from a central point 29 to achieve the same central peak of the primary explosion. The operation of the central charges of FIG. 3 is initially similar to known prior art.

End charges 16 and 17 are mounted at opposite ends of each charge unit, for example at the upper and lower ends, respectively, of the casing 12 of FIG. 1, which contains a single charge unit. Each end charge is designed to be peripherally initiated so that the explosion collapses upon itself to create unusually high pressures directed toward the site of the central charge load. Peripheral initiation may be accomplished by having the body of each end charge 16, 17 capped by a buffer layer 32 of inert material that is of slightly smaller diameter than the end charge. The buffer 32 is then covered by a sheet of medium intensity explosive 33 such as Detasheet, which may also extend circumferentially around buffer 32 in direct contact with the high explosive of end charge 16, 17. The sheet explosive 33 is centrally detonated, for example at 34, and the buffer attenuates the shock of detonation from the main explosive body. The explosion expands from the center of the sheet explosive to the outer margin of the buffer 32, and then moves radially inwardly as the body is detonated on the inward side of the buffer. Preferred buffer materials include mild steel, brass, plywood, masonite, and aluminum. Preferred high explosive for the main body of end charges 16, 17 may be adapted to the environment in which the apparatus will be used, but TNT, RDX, HNS, and PETN are suitable examples.

The inner face 18 of body 16, 17 is covered with a liner 37 of reactive metal such as woods-metal, sodium, lithium, magnesium, magnesium-lithium alloy, magnesium-lithium-aluminum alloy, or zinc. The reactive metal will vaporize during the explosion of the high explosive body 16, 17 and will then combine with oxygen in a reaction that acts as an energy sponge that later releases its energy to create a prolonged period of high pressure that fractures the earth. The named reactive metals are preferred as having a minimal fouling effect of the well. A lining reactive metal approximately one-fourth inch thick has been found suitable to produce the desired enhancement of pressure for prolonged times.

In the embodiment of FIG. 3, the end charge has a conical outer face projecting to apex 40, where the charge is detonated. The explosion spreads down the conical portion 42 and through uniform disk portion 44, vaporizing reactive metal liner 37 as before and directing the force of the explosion toward the central charge area. In this embodiment, each end charge may have a diameter of three inches, conical portion 42 may have a height of one inch, disk 44 has a thickness of one-half inch, and the metal liner 37 may have a thickness of one-half inch. Each end charge may be suspended in a plastic foam.

End charges 16 and 17 of FIG. 1 may be pancake charges or their inner face 18 may be dished concavely to better direct the force of the secondary explosion toward the central area of the charge unit 11. It is notable that the typical conical or linear shaped charge ignites from the apex of its recess, while the end charges 16 and 17 are peripherally ignited to be inwardly directed in a collapsing design. It has been found that the ratio $R_1$:$R_2$ may be adjusted within a broad range to tailor the explosive characteristics of apparatus 10 for different functions, where $R_2$ is the radius of curvature of the dished face 18 and $R_1$ is the radius of the end charge taken transversely to the longitudinal axis of casing 12. A ratio $R_1$:$R_2$=2 is well suited for penetrating steel, while a preferred range for the ratio is from one to four. In the embodiment of FIG. 1 $R_2$ is also the inner radius of casing 12, while in the embodiment of FIG. 3, $R_2$ is only approximately seventy-five percent of the radius of the casing.

The void areas 19 between the end charges and the central charge load 14 serve a number of important purposes. First, the voids provide space for the dished end charges to form inwardly directed jets of ionized metal plasma, concentrating the pressure of the explosions on the central area of the charge unit 11. Ideally, forces of the opposed end charges will meet at the center of the charge unit, where the forces will mushroom transversely to the axis of the casing and enhance the pressure generated by the primary explosion of the central charges. Second, the voids 19 create a time delay between the impact of the central charge detonation and the end charge detonation on the strata surrounding the well bore. The delay allows the central shaped charges to perforate the well pipe and initiate some cracks in the strata before the force of the secondary explosions reaches the strata to produce greatly increased pressures that will enlarge the cracks. If the end charges are detonated at the same time as the central charges, the axial length of the voids 19 may be adjusted to produce the desired delay, as the detonation velocity of a typical high explosive if from 22,000 to 23,000 feet per second. If the delay is accomplished by detonating the end charges after the detonation of the central charges, then the length of voids 19 need only be great enough to allow jet formation. Third, the voids 19 contain oxygen or an oxidizing agent that can react with the ionized cloud of metallic vapor formed from the metal liner 37 during the explosion of the end charges. The reaction between the metallic vapor cloud and the oxygen results in greatly increased pressures generated by the explosion of apparatus 10 and also results in a prolonged period of high pressure that substantially increases the efficiency of the fracturing.

In the apparatus of FIG. 1, the axial length of each void 19 is equal to the diameter of the casing 12, for example three inches. In the apparatus of FIG. 3, the length of each void is only one inch, while the diameter of the casing is four inches.

Any known form of detonating device may be used with apparatus 10. One form of suitable detonating system includes a standard electrical detonator cap connected by a firing line to a surface source of electricity. The electrical cap in turn is connected to individual detonators in apparatus 10 by mild detonating fuse 46 (MDF). The length of the MDF leading to the detonators 47, 49 on central charge 14 is either equal to or shorter than the length of MDF leading to the detonators 34 on the end charges. It is relatively important that the end charges be detonated at the same instant, as a variation of four microseconds between their detonations will cause the explosions to meet approximately one inch off center, decreasing the efficiency of pressure reinforcement. It is believed that four microseconds difference in detonation time is approximately the maximum error permitted to substantially gain the benefits of the invention.

The earth fracturing apparatus 10 has been demonstrated to generate far greater useful pressures than have been achieved in the prior art. The apparatus concentrates the energy of the explosives and focuses it, for example by wave shaping, for highly efficient energy utilization. The key features that achieve this result are the design of the end charges and the use of reactive metals, examples of which have been given above. A reactive metal is one which will form an ion plasma or "metallic vapor" under the conditions of temperature and pressure existing in the environment of the apparatus during and immediately following detonation. For example, if aluminum is used as the reactive metal, the aluminum solid will first be melted to liquid and then vaporized finally becoming ionic aluminum, $Al^{+3}$, as electrons are stripped from the vaporized atoms. In the presence of oxygen, the ions will form AlO vapor, then $Al_2O_3$ liquid, and finally $Al_2O_3$ solid. If this sequence of reactions were analyzed with respect to the laws of thermodynamics, the rate limiting step would be the combination of $Al^{+3}$ with $O_2$ in the vapor state. The apparatus 10 takes advantage of this energy consuming step to act as an "energy sponge" that absorbs the instantenous energy of the explosion and then releases this energy over a prolonged period to generate high pressures in well hole and mineral bearing strata.

In operation, earth fracturing apparatus 10 is lowered into a well by conventional means such as a cable attached to the top of casing 12. When the apparatus is stationed at the proper depth in the well, the central charge load is detonated by any conventional means. Where the central charges are linear shaped charges aligned parallel to the axis of the casing as illustrated in FIG. 1, the linear charges will focus the force of their explosion in a radially outward direction to cut through the casing 12, through the pipe lining the bore hole, and through grout, if any, holding the well pipe in place. In addition, the linear charges will cause some fracturing of the earth surrounding the well. Where the central shaped charges are conical in shape, the charges will tend to punch circular holes in the sides of the well. Other forms of shaped charges could be used with the resultant hole formation being as anticipated in the prior art, it being understood that the central charge load should direct its energy against the cylindrical side of the casing 12 and against the side of well for optimum results.

End charges 16, 17 may be simultaneously detonated at the same moment as the detonation of the central charges, the simultaneous detonation of charges 16, 17 may be slightly delayed, for example by up to 10 microseconds. The end charges are peripherally initiated and generate a Mach stem, which is defined in the art as an overdriven detonation wave of pressure greater than the usual Chapman-Jouquet (C-J) detonation pressure. The end charges generate sufficient temperature and pressure to vaporize the reactive metal coating in the inner face of each charge, resulting in a near-field effect as the metallic vapor reacts with the oxygen in the void area between the end charges and the central charges.

The end charges greatly reinforce the action of the central charges merely by bringing together the forces of the two end charges at a detonation velocity of from 22,000 to 23,000 feet per second, the forces of the two charges meeting at substantially the center of the area formerly occupied by the central charges. This reinforcement tends to enlarge those fractures in the earth created by the central charges.

In addition to the reinforcement caused by the slight delay of the second explosive force in reaching the site of the first explosion, a far greater reinforcement is achieved through the kinetics of the exothermic reaction between the metal vapor and oxygen. This reaction was fueled during the initial explosion of the end charges and continues to enhance the pressures generated by the end charges for a time in excess of the expected duration of such high pressures when only conventional explosives are used. The long duration of these overpressures propagates cracks in the strata surrounding the well that are far greater than have been produced with equivalent quantities of explosive materials using prior technology.

A number of tests were performed with earth fracturing apparatus 10 to substantiate the superiority of its operation. First, an explosive apparatus like that described in U.S. Pat. No. 3,762,327 to Edgell, using a time delay between initiation of the central charge and the end charges and having a liquid filling void areas in the casing, was detonated in a six foot cube of aged concrete. The Edgell device produced small puncture holes in the test well pipe but formed no cavity in the concrete. Second, an unrefined test apparatus 10 similar to that shown in FIG. 1 was detonated in a six foot cube of aged concrete. The apparatus produced a cavity having a volume of 10,300 cubic inches. Third, a reference charge containing an amount of explosive equal to that in the second test was detonated in a six foot cube of aged concrete, producing a cavity of 2,050 cubic inches. The result of these tests indicates that the earth fracturing apparatus 10 generates a cavity over five times as large as is achieved with an equal quantity of conventionally detonated and configured explosive.

The performance of apparatus 10 as reported in the above test represents the most basic improvement over conventional well treating explosives. A number of modifications are easily made that can substantially improve the earth fracturing ability of the apparatus. Void spaces 19 may be filled with any pressurized gas to increase the overall pressures generated by the apparatus. According to Sachs Scaling Law, increasing the ambient pressure increases the peak overpressure, impulse, and duration of the shock waves generated by the explosive at a specific distance. An increase in the ambient pressure by a factor of two, i.e., about 30 p.s.i., would increase the effective weight of a one pound charge to 1.364 pounds, and an increase in pressure by a factor of three would increase the effective weight to 1.705 pounds.

In the reported test explosion, the gas in the void spaces was unpressurized air. The performance of the apparatus would be further improved through the use of pressurized air, pure oxygen, pressurized pure oxygen, or any other gaseous oxidizer, either pressurized or unpressurized. The presence of an oxidizer would increase the reaction with the metallic vapor cloud and result in greater enhancement of pressures.

A related improvement would be to increase the quantity of reactive metal available for evaporization. Therefore, it should be noted that the preferred material for casing 12 is reactive metal, as suggested above. Similarly, the back sides of the central shaped charges may be reactive metal, and the spaces 50 between shaped charges 25 of FIG. 2 may be filled with reactive metal, leaving required space for MDF and detonators. Any of the added reactive metal that is vaporized by the explosion may participate in the reaction with oxygen to intensify the degree of earth fracturing.

Figure 4:
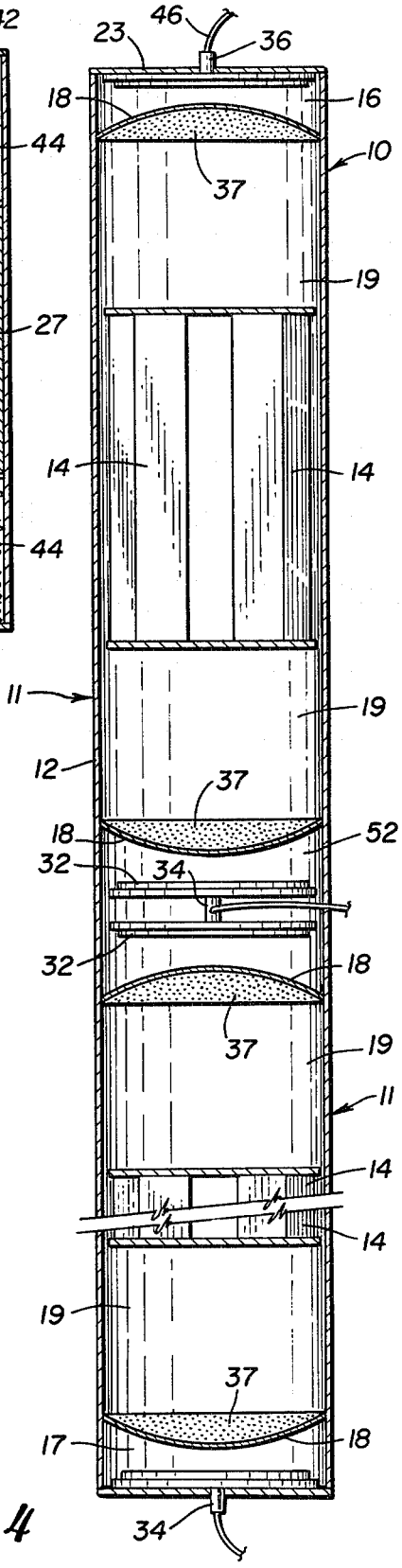
FIG. 4 is a vertical cross sectional view of an earth fracturing apparatus consisting of a plurality of charge units.

The embodiment shown in FIG. 4 offers additional improvements in efficiency of earth fracturing. Casing 12 has been axially lengthened to contain a plurality of charge units 11, for example two or more. Each charge unit has a central charge load 14 similar to those previously described. Voids 19 separate the central charge load from a pair of opposed end charges having reactive metal liners facing the central charge. End charges 16 and 17 may be similar to the pancake or dished charges already described, with an upper charge 16 and a lower charge 17 abutting between adjacent charge units. Alternatively, the abutting charges may be replaced with a single end charge 52 of special configuration, having central detonating means 34 and a buffer layer 32 both above and below the detonating means. Thus, a single detonator will initiate the explosion of one end charge serving two charge units, simplifying the exact timing needed to coordinate the detonation of a plurality of charge units.

Simultaneous detonation of a plurality of charge units, as in the apparatus of FIG. 4, produces earth fracturing greater than would result from the sum of the fracturing resulting from an equal number of independently detonated charge units. While each unit 11 forms its own high pressure area approximately in a plane normal to the axis of the unit at the central charge load, simultaneously detonated units form a second area of extensive rock fracturing in a normal plane at the midregion between adjacent units 11, for example in the plane transverse to charge 52. The rock in this midregion is placed in tension by the shock waves from the explosions both above and below the midregion, as the shock waves from the explosions are mutually reflected. Studies show that the resulting pressures exerted on the midregion rock are equivalent to the detonation of a charge two and one-half times as large as the actual explosive used at the location of one of the charge unit centers.

The operative concept of the multiple charge unit apparatus of FIG. 4 is the same as in earlier described embodiments, in that a reactive metal liner 37 on the end charges forms a vapor that reacts with oxygen to increase pressures and prolong the period of high pressure, propagating and enlarging cracks in the mineral bearing formation. Because of the superior rock fracturing achieved with a multiple charge unit apparatus, the cavity so formed is well suited to hold large quantities of high explosive for secondary fracturing.

The superior fracturing achieved with any embodiment of apparatus 10 increases the efficiency of other well treating techniques, such as hydrofracing.

In the embodiments illustrated in FIGS. 1, 2 and 4, the liner vanes of the central charge load 14 are double-ended and are detonated from each end simultaneously, for example by detonators 47 and 49 of FIG. 1 acting on sheet explosive 28. This type of detonation causes the linear vane to generate a collapsing, outwardly directed shock wave near the axial center of the vane. This type of detonation makes the central charge load 14 composed of linear vanes 25 exceptionally effective for cutting vertical slits in the casing of a well. It is anticipated that this portion of the invention may be used either with or without the aid of the opposed end charges 16 and 17 for perforating well casing. If a casing perforator having a plurality of charge loads 14, as illustrated in FIG. 4, were used without the benefit of end charges 16, 17 or 52, the resulting earth fracturing would still be greater than caused by an equal number of independently detonated charge loads 14 initiated from one or both ends.

I claim:

1. An improved earth fracturing apparatus of the kind having an elongated casing containing a pair of opposed end charges and a laterally directed intermediate charge, wherein the improvement comprises:

(a) said laterally directed charge being substantially centrally located along the axial length between the oppositely directed end charges for creating a central area of high pressure upon detonation;

(b) each of the end charges having a liner of reactive metal on its respective inwardly directed face for forming a metallic vapor upon detonation of the end charge;

(c) the end charges and the centrally located laterally directed charge being substantially spaced along the axis of the casing to form a void area between the central charge and each end charge, the void containing an oxidizer that reacts with the metallic vapor upon detonation of the end charges to enhance the period of high pressure resulting from detonation of the end charges; and (d) detonating means for exploding the centrally located charge and the end charges, the end charges being detonated substantially simultaneously at a time no sooner than the detonation of the centrally located charge, the shock waves of the end charge detonations meeting near the position of the centrally located charge to reinforce the pressures generated by explosion of the centrally located charge.

2. The apparatus of claim 1, wherein said end charges are dished on their mutually facing surfaces to direct the force of their explosion in a focused path toward said centrally located charge.

3. The apparatus of claim 1, wherein said end charges further comprise a cylindrical main body of high explosive material, a buffer layer covering the central portion of the axially outwardly facing surface of the main body, a layer of relatively milder explosive material on the outwardly facing surface of the buffer layer, and detonating means for exploding the milder explosive material, the buffer attenuating the shock of detonation from the main body and protecting the main body from the explosion of the milder explosive until the explosion reaches the margins of the buffer layer and peripherally initiates the main body to form a radially inwardly collapsing detonation wave that enhances the pressures generated in the explosion.

4. The apparatus of claim 1, wherein said end charges are cylindrical and are dished on their axially inwardly facing surfaces, the ratio of the radius of curvature of the dished surface to the radius of the cylindrical end charge being between one (1) and four (4).

5. The apparatus of claim 1, wherein the ratio of said radius of curvature to said radius of the end charge is two (2).

6. the apparatus of claim 1, wherein said detonating means initiates both the central charge and the end charge at substantially the same instant, said void areas providing a time delay between the detonation of the central charge and the impact of the end charge explosions on the area of the central charge.

7. The apparatus of claim 1, wherein the material for said reactive metal liner is selected from a group of materials consisting of woods-metal, lithium, magnesium, aluminum, sodium, zinc, and alloys thereof.

8. The apparatus of claim 1, wherein said reactive metal liner is composed of a material that vaporizes into an ionic plasma under the environmental conditions of temperature and pressure associated with the explosion of said end charges.

9. The apparatus of claim 1, wherein said void area contains pressurized gas.

10. The apparatus of claim 1, wherein said void area contains a pressurized gaseous oxidizer.

11. The apparatus of claim 1, further comprising a plurality of said laterally directed charges at axially spaced intervals within said casing, each axially spaced laterally directed charge being between a pair of said end charges, said detonating means simultaneously exploding the laterally directed charges and simultaneously exploding the end charges.

12. The apparatus of claim 11, wherein said laterally directed charges are double-ended linear vanes, and said detonating means further comprises a sheet of explosive on each end of each linear vane for simultaneous detonation of both ends of the vanes.

13. The apparatus of claim 11, wherein the end charges between said axially spaced laterally directed charges are dished on both upper and lower faces and have a pair of spaced, centrally located buffer layers with a detonator between the buffer layers, a single charge serving as both the upper end charge for one laterally directed charge and the lower end charge for an upwardly adjacent, laterally directed charge.

14. An improved earth fracturing apparatus of the kind having an elongated casing containing a pair of opposed end charges and a laterally directed intermediate charge, wherein the improvement comprises:

(a) said laterally directed charge being substantially centrally located along the axial length between the oppositely directed end charges for creating a central area of high pressure upon detonation;

(b) each of said end charges having a main body of high explosive with an inward side facing toward said laterally directed charge;

(c) means for peripherally initiating the explosion of said main body to form a high pressure detonation wave collapsing over said inward side;

(d) said end charges being axially spaced from the laterally directed charge in the casing to form a void area therebetween, the void providing space for the high pressure detonation wave to form; and (e) detonating means for exploding the centrally located charge and the end charges, the end charges being detonated substantially simultaneously and at a time no sooner than the detonation of the centrally located charge, the shock waves of the end charge detonations meeting near the position of the centrally located charge to reinforce the pressures generated by explosion of the centrally located charge.

15. The apparatus of claim 14, wherein said end charges further comprise a liner of reactive metal on said inward side and said void area contains an oxidizer to react with the reactive metal upon detonation of the end charges.

16. The apparatus of claim 14, wherein said void area contains pressurized gas increasing the pressures generated in the explosion of the apparatus.

17. The apparatus of claim 14, wherein said laterally directed charge is a double-ended linear shaped charge directed outwardly from an axis between the end charges, and said detonating means is connected to simultaneously detonate the opposite ends of the laterally directed charge.

18. The apparatus of claim 14, wherein said laterally directed charge is a conical shaped charge directed outwardly from an axis connecting the end charges.

19. The apparatus of claim 14, wherein said means for peripherally initiating the main body of high explosive in each end charge is a buffer layer covering the central portion of the outer side of the main body and a sheet of relatively milder explosive covering the outer side of the buffer layer and contacting the main body at the outer margins of the buffer layer.

20. The apparatus of claim 19, further comprising detonating means centrally contacting said milder explosive sheet and separated from said main body of high explosive by the buffer layer.

21. The apparatus of claim 14, wherein said means for peripherally initiating the main body of high explosive is a conical outer portion of the main body forming an outwardly directed apex, and detonating means connected to said apex.

22. An improved earth fracturing apparatus of the kind having an elongated casing containing a pair of opposed end charges and a laterally directed intermediate charge, wherein the improvement comprises:

(a) said laterally directed charge being located near the center of the axial length between the oppositely directed end charges for creating a central area of high pressure upon detonation;

(b) each of said end charges having a main body of high explosive with an inward side facing toward said laterally directed charge;

(c) means for peripherally initiating the explosion of said main body to form a high pressue detonation wave collapsing over said inward side;

(d) said end charges being axially spaced from the laterally directed charge in the casing for a sufficient distance to permit formation of a high pressure detonation wave therebetween; and (e) detonating means for exploding the centrally located charge and the end charges in predetermined sequence.

* * * * *